US005500834A

United States Patent [19]

Sakaki et al.

[11] Patent Number: 5,500,834

[45] Date of Patent: Mar. 19, 1996

[54] DEVICE FOR MEASURING TIME LAPSE AFTER TURN OFF OF POWER SOURCE AND METHOD THEREOF

[75] Inventors: Eihiro Sakaki, Choufu; Yoshimi Ogasawara, Yokohama; Eiichiro Teshima, Kawasaki, all of Japan

[73] Assignee: Canon Kabushiki Kaisha, Tokyo, Japan

[21] Appl. No.: 296,179

[22] Filed: Aug. 29, 1994

[30] Foreign Application Priority Data

Sep. 3, 1993 [JP] Japan ..... 5-219789

[51] Int. Cl.[6] ..... G04F 8/00

[52] U.S. Cl. ..... 368/9; 368/121; 368/118; 368/89; 368/107

[58] Field of Search ..... 368/1–10, 107–121, 368/89

[56] References Cited

U.S. PATENT DOCUMENTS 3,490,890 2/1974 Doittau et al. ..... 368/121
3,581,196 5/1974 Spaid ..... 368/118
3,854,281 12/1974 Reichert ..... 368/9
4,879,647 11/1989 Yazawa ..... 368/121

*Primary Examiner*—Bernard Roskoski
*Attorney, Agent, or Firm*—Fitzpatrick, Cella, Harper & Scinto

[57] ABSTRACT

While the electric power source is turned on, capacitor 1 is charged to a voltage EO by a direct current constant voltage supplier through transistor 4. When the electric power is disconnected, transistor 4 is switched off to discharge capacitor 1 through resistor R1. When the power source is turned on, the voltage of capacitor 1 is read by A/D converter to be produced and stored in CPU 12 memory. Then transistor 4 is switched on to charge capacitor 1 to the voltage EO. Then transistor 4 is switched off and transistor 5 is switched on to discharge capacitor 1 through resistor R2 and a counter stars. When the voltage of capacitor 1 reduces to the same voltage stored in the memory, transistor 5 is switched off to stop the counter and to obtain the counted value t2. Then transistor 4 is switched on to prepare for the next operation. The time lapse t1 after the power source being turned off is obtained by a formula (R1/R2)×t2.

18 Claims, 6 Drawing Sheets

DEVICE FOR MEASURING TIME LAPSE AFTER TURN OFF OF POWER SOURCE AND METHOD THEREOF

BACKGROUND OF THE INVENTION

1. Field of the Invention

The present invention relates to a device and a method for measuring time lapse after turned off of power source of OA equipments and etc.

2. Description of the Prior Art

FIG. 5 is a circuit diagram of a conventional device for measuring the time lapse after turned off of the electric power source by using a capacitor. In the diagram, the numeral 1 denotes a capacitor (Capacitance C), in which there is an equivalent internal parallel resistor 2 (Resistance R3) of about 50 megohm resulting so called leakage current rather small.

The charging circuit of capacitor 1 consists of transistor 4, a load resistor 8 for transistor q, a rush current limiting resistor 6, and a direct-current constant-voltage supplier.

On the other hand, the discharging circuit for capacitor 1 consists of a resistor 13 (Resistance R1) for determining discharge time constant. Numeral 11 is an A/D converter for the conversion of the voltage of capacitor 1 into digital signal to be sent to CPU 12 as mentioned hereunder.

Numeral 12 is a CPU to calculate the time lapse after turned off of the electric power source based upon the output signal of A/D converter 11, and to switch transistor 4 ON to charge capacitor 1.

Then, the explanation is made on the control operation of CPU 12. Prior to turn off of the power source, transistor 4 is ON-conditioned and the capacitor 1 is under the charged state of saturation voltage EO.

At the time of turn off of the power source, transistor 4 is simultaneously switched OFF and the voltage of capacitor 1 is decreased with the lapse of time by discharging through resistor 2 according to the formula below.

$$V = EO \times EXP(-t/(C \times (R1//R3)))$$

(*R1//R3* represents a parallel resistance value of both resistors)

When R3>>R1, $$V=EO\times EXP\ (-t/(C\times R1) \quad (1)$$

So, in this case, the discharge through leakage resistance R3 is negligible.

After some elapsing of time from the turn off of the power source, and when the power source is turned on again, CPU 12 reads out an output of A/D converter as the capacitor voltage V1 and calculates the time lapse from the time of the electric power source turned off by applying a voltage/time conversion table not shown. In the conversion table, there is the calculation result derived from following formula:

$$t=-C\times R1\times LN\ (V1/EO) \quad (2)$$

: LN is a natural logarithm

After determining the time lapse from the time of turned off of the power source by calculation, then CPU 12 switches transistor 4 ON for charging of capacitor 1 to prepare for the next turn off of the power source.

FIG. 6 is a flow chart showing the above-mentioned control operation.

With turn off of the electric power source the value of A/D converter 11 is read (S 200) to obtain the time lapse after the power source turned off by applying conversion table LUT (LUT: Leak Up Table) not shown (S 201). Thereafter, transistor is switched ON (S 202) to prepare for the next turn off of the power source.

However, the electrostatic capacitance C of capacitor 1 generally has an variation range of approx. +—(plus minus) 20% to bring about a large measuring error of time lapse after turned off of the electric power source.

For instance, when there is an +20% error on C value, lapse time given from formula (2) is:

$$t=-C\ (1+0.2)\times R1\times LN\ (V1/EO) \quad (3)$$

Consequently, the difference from the genuine value will amount to +20%.

Therefore, the conventional device for measuring time lapse after the power source turned off by using capacitor gives a big error and is not appropriate for high accuracy measurement. In this connection, a time measuring device backed-up with battery is conventionally applied to measure the time lapse after the power source is turned off. This kind of time measuring device is normally high in cost and requires extra-cost for dismantling some parts like a battery which include noxious materials and must be recovered.

SUMMARY OF THE INVENTION

The object of the present invention is to provide with a time lapse measuring device and a measuring method thereof without the disadvantage as mentioned above.

Another object of the present invention is to provide with a measuring device and a measuring method without a measuring error caused by inaccuracy of capacitance.

A further object of the present invention is to provide with a measuring device and a measuring method for accurately measuring time lapse, applying a simulation of capacitor discharge during the power source being turned off by applying another time constant after the power source is turned on again.

A still further object of the present invention will become clear in the explanation made by attached drawings and claims.

DETAILED DESCRIPTION OF PREFERRED EMBODIMENTS

Figure 1:
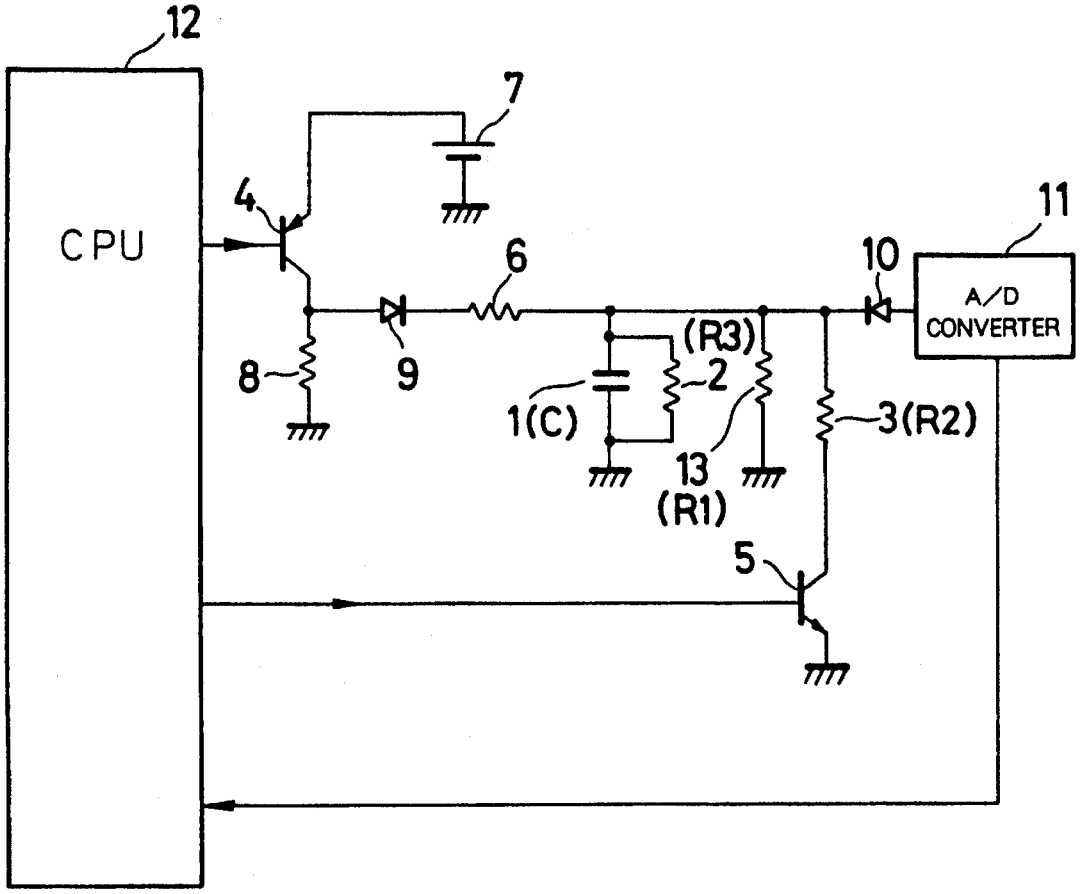
FIG. 1 is a circuit diagram illustrating the embodiment 1 of the present invention.

FIG. 1 is a circuit diagram illustrating the structure of the device for measuring time lapse after turned off of the power source and the method thereof. It should be noted that the same reference numerals in each drawing designate the same components or the elements.

In FIG. 1, numeral 1 indicates a capacitor (Capacitance C), in which there is an internal parallel resistance (resistance value R3) of approximately 50 megohm and the leakage current is small. The charging circuit of capacitor 1 consists of transistor 4 to be connected to CPU 12 and to actuate as switch, a resistor 6 to determine the charging time constant and a direct current constant-voltage supplier 7.

On the other hand, the discharging circuit of capacitor 1 consists of a resistor 1B (resistance value R1) to determine the discharging time constant after the power source being turned off, a resistor 3 (resistance value R2) to become a discharging circuit after the power source is turned on, and a second transistor 5 to be connected to CPU 12 and to work as switching means.

Numeral 11 is an A/D converter to convert the voltage value of capacitor 1 into digital value and is connected to CPU Numerals 9 and 10 are diodes, which are provided to reduce the leakage of the electric charge of capacitor 1 from load resistor 8 and A/D converter Numeral 12 is a CPU, which controls operation as follows. When the calculation of time lapse after the power source being turned off based on the output value of A/D converter 11 is over, transistor 4 is switched ON to charge the capacitor then transistor 4 is switched OFF to open the charging circuit and to discharge capacitor 1 by switching ON transistor 5.

Then, the explanation is made on the control operation of CPU 12. Prior to the power source being turned off, transistor 4 is ON-conditioned and the capacitor 1 is already charged sufficiently to reach a saturated voltage EO. Immediately after the power source being turned off, transistor is switched OFF as well as in the case of transistor 5 to result in the discharge of capacitor 1 through resistor 13, reducing the capacitor voltage V as in the conventional case.

After a period of time from being turned off of the power source and when the power source is turned on again, CPU reads out the output of A/D converter as the capacitor voltage V1, and store the read value in the memory of the CPU 12 not shown.

Then, transistor 4 is switched ON to charge capacitor 1 up to the approximate value of a predetermined voltage EO. After charging of capacitor 1, transistor 4 is switched OFF to cut off charging circuit. At the same time, transistor 5 is switched ON to begin electric discharge through resistor 3 and to begin counting by a counter (not shown) in CPU 12. By the electric discharge, capacitor voltage V is decreased according to the following formula:

$$V = EO \times EXP(-t/(C \times (R2//R3//R1)))$$

($R2//R3//R1$ represents combined parallel resistance values)

when R3>>Ri>>R2

$$V=EO\times EXP\ (-t/(C\times R2)) \quad (4)$$

This formula shows that the electric discharge through leakage resistance 2 and resistor 13 becomes negligible.

Assuming that t1 is the time for the capacitor voltage to reach V1 by discharging electric charge of capacitor 1 through resistor 13 after being turned off of the electric power source, then, $$t1=-C\times R1\times LN\ (V1/EO) \quad (5)$$

Assuming that time t2 is the time for the capacitor voltage to reach V1 which is the same value stored in the memory by discharging electric charge of capacitor 1 through resistor 3 after being turned on of the electric power source, then, $$t2=-C\times R2\times LN\ (V1/EO) \quad (6)$$

From the Formulas (5) and (6)

$$t1=(R1/R2)\times t2 \quad (7)$$

Formula (7) shows that the time lapse calculation after the power source being turned off is fully independent of the capacitance of the capacitor 1, and the time lapse is calculable by multiplying a predetermined resistance ratio (R1/R2) by time t2 which is the time lapse of electric discharging measured after the power source turned on. This calculation is conducted in CPU 12.

Figure 2:
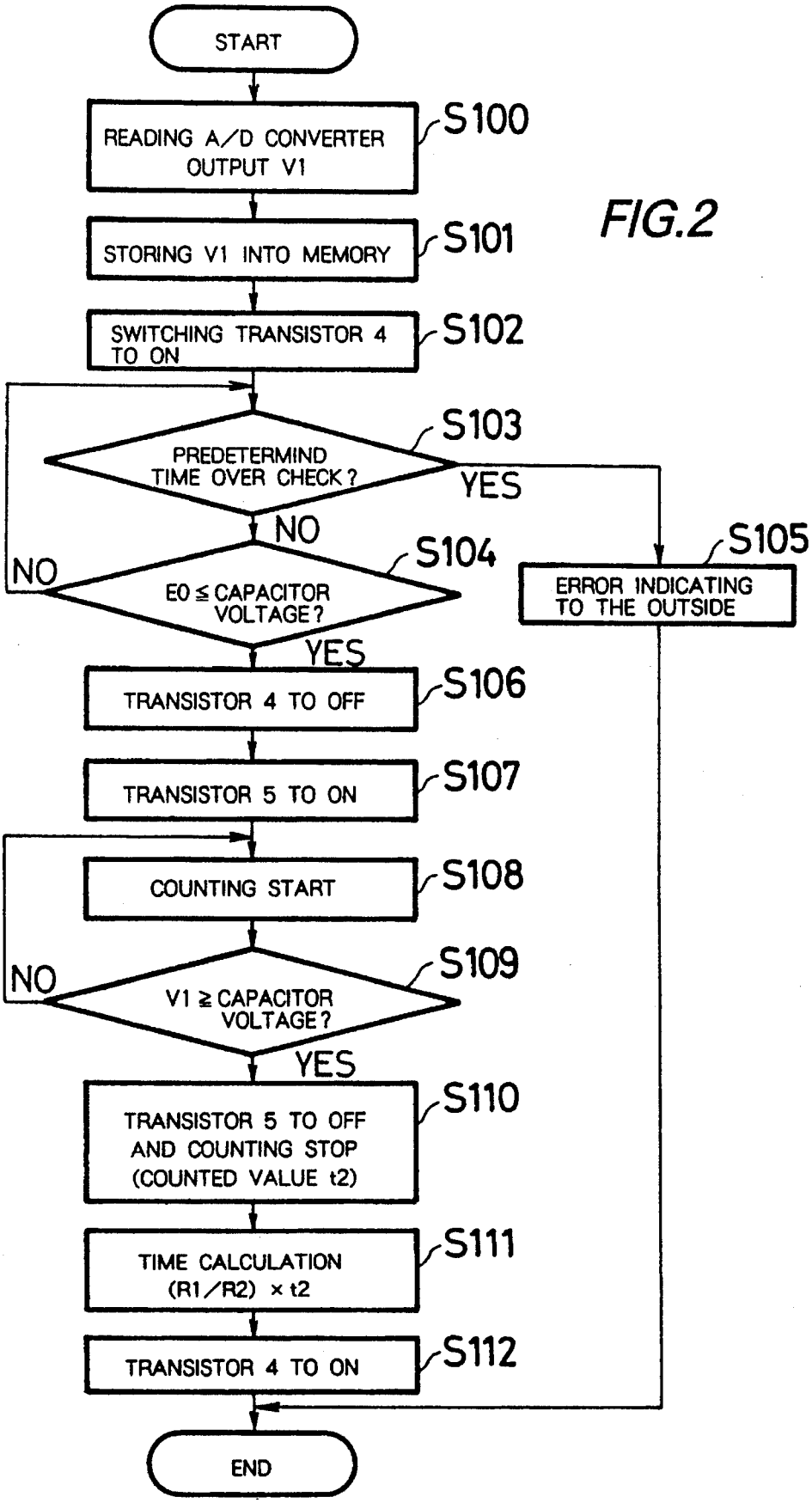
FIG. 2 is a flow chart of the operation according to the embodiment 1.

FIG.2 is a flow chart illustrating the above mentioned CPU 12 control process.

When the power source is turned on, CPU 12 reads the output value of A/D converter 11 (S100), and the read value is stored in the memory not shown (S 101).

Then CPU 12 continues to keep transistor 4 ON-conditioned until the capacitor voltage reaches the approximate value of predetermined voltage EO (S102–S104).

If the capacitor voltage does not attain predetermined voltage value EO within predetermined time T (S103, YES), CPU 12 indicates the error to the outside equipment such as a computer and others not shown, and terminates the control.

When the capacitor voltage attains predetermined voltage value EO within predetermined time T (S104, YES), CPU 12 switches transistor 4 OFF (S106) and switches transistor 5 ON (S107) at the same time and begin time measuring (S108). When the capacitor 1 voltage attains V1 which is as same value as stored in the memory (S109, YES), CPU 12 switches transistor 5 OFF to stop time lapse counting (S110), and calculate the time lapse by multiplying counted value t2 by the ratio (R1/R2) preliminarily stored in the memory in order to obtain the time lapse t1 after the power turned off (S111). Then, transistor 4 is switched ON (S112) to prepare for the coming turned off of the power source.

Figure 3:
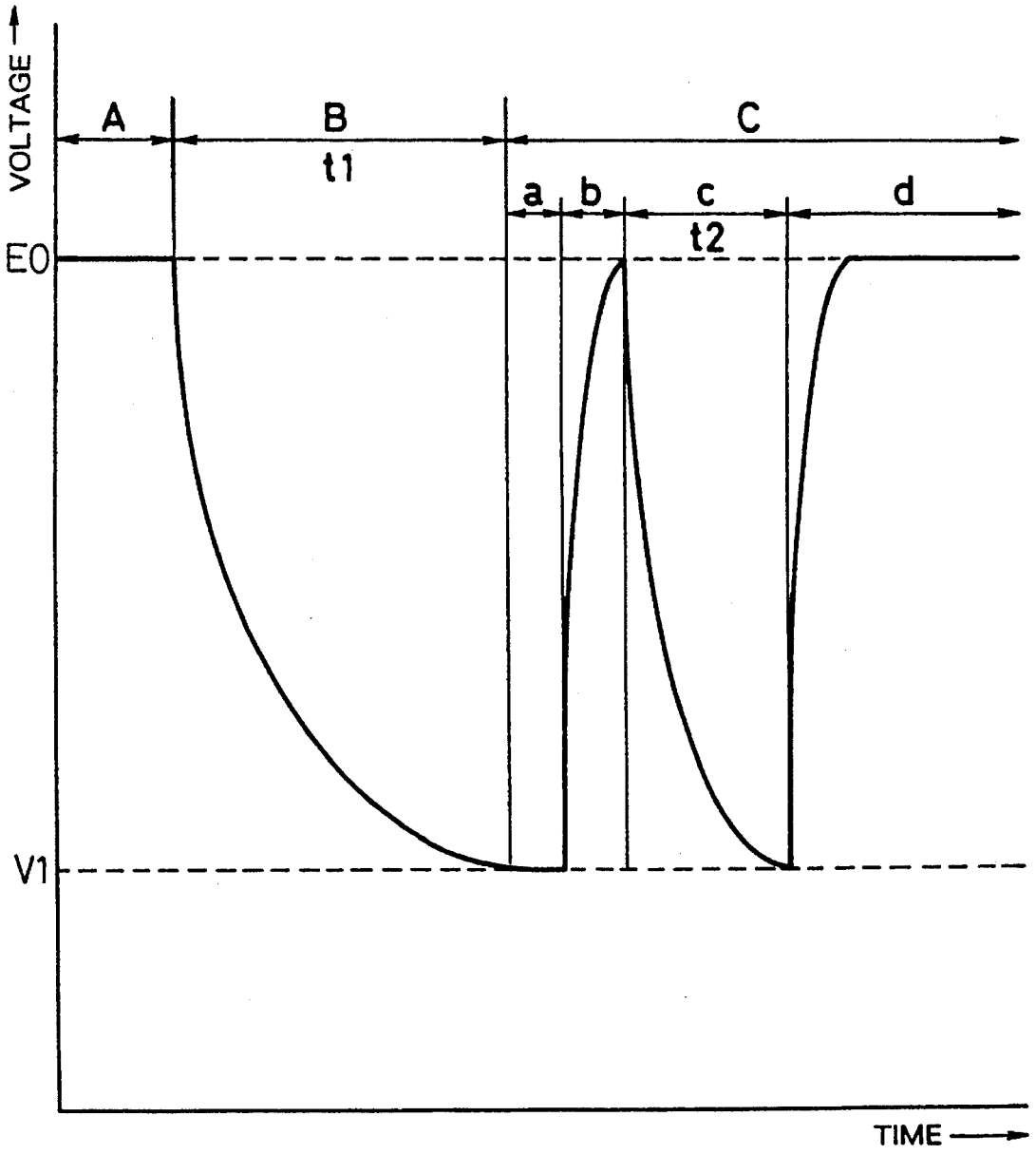
FIG. 3 is a graph illustrating the voltage change of capacitor 1 of FIG. 1.

FIG. 3 is a graph showing the voltage of capacitor 1 during the above-mentioned control.

The period A indicates the period just before the power source being turned off. The period B indicates the period during which the power source is turned off. The period C indicates the period after the power source is turned on again.

In the period C, the period a indicates the time required for storing A/D converter output into the memory. The period b indicates the time needed for charging capacitor 1, the period c indicates the discharging time of capacitor 1 through resistor 3, and the period d is a period of charging of capacitor 1 to prepare for the next turned off of the power source. That is to say, by conducting a simulation of capacitor 1 discharge under applying smaller time constant, it becomes possible to obtain the time lapse within short time.

Further, instead of getting the result of the above mentioned formula (7) by calculation, it is also possible to set up a conversion table relating to the lapse time t1 and the counted value t2, and then obtain t1 from the conversion table.

In the above-mentioned embodiment 1, there is a premise that the resistance ratio (R1/R2) can be selected appropriately. Especially, by making a selection that this resistance ratio and the counting interval of counter becomes an integer, the multiplication becomes simple.

The example is given as an embodiment 2 hereunder. For instance, when the selected resistance ratio is 60 and the selected counting interval is one second, then the time lapse after the power source being turned off is identically indicated in minutes at the counted number of the counter. This simplifies the measuring of time lapse.

Figure 4:
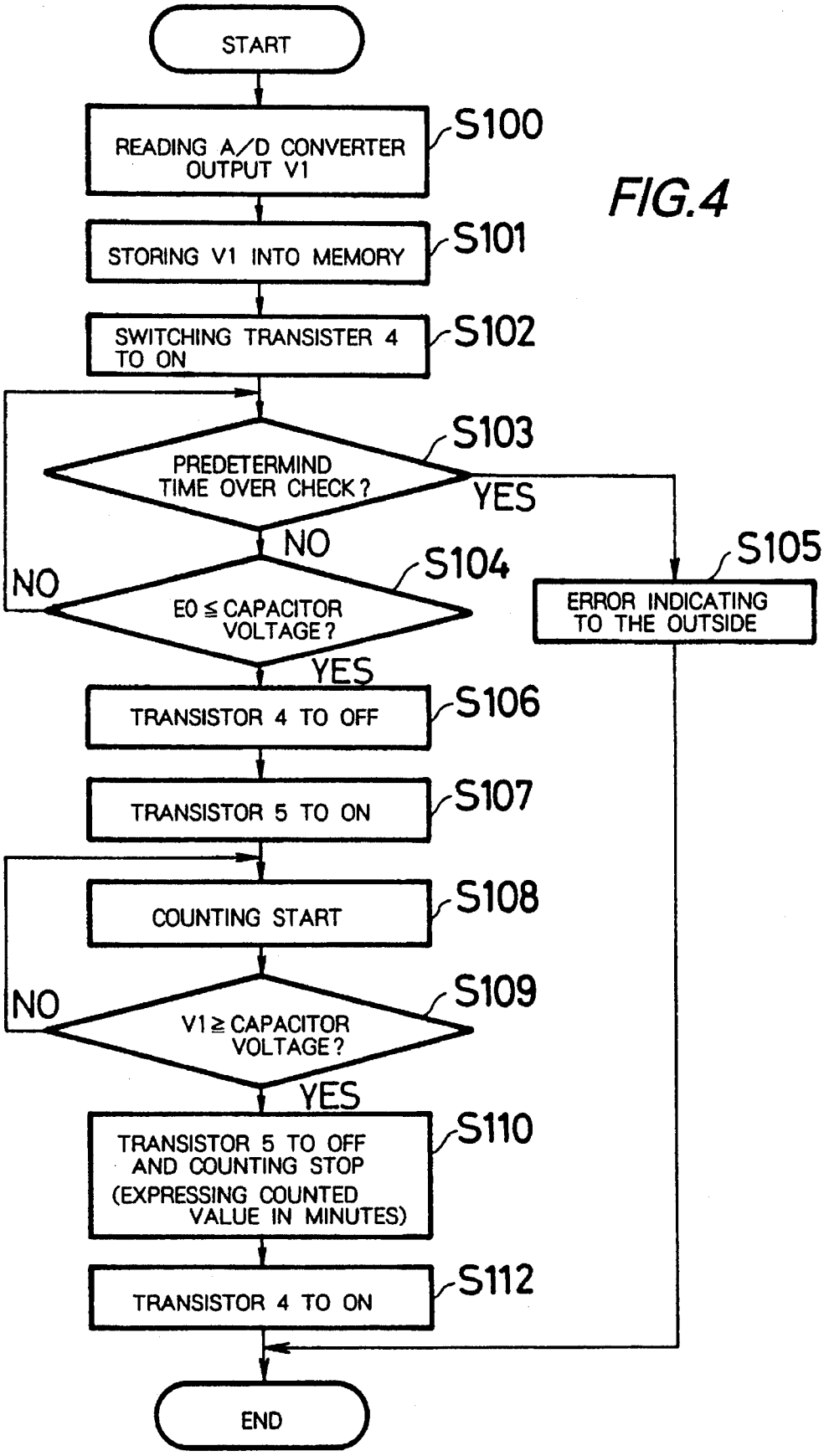
FIG. 4 is a flow chart of the operation according to the embodiment 2.
Figure 5:
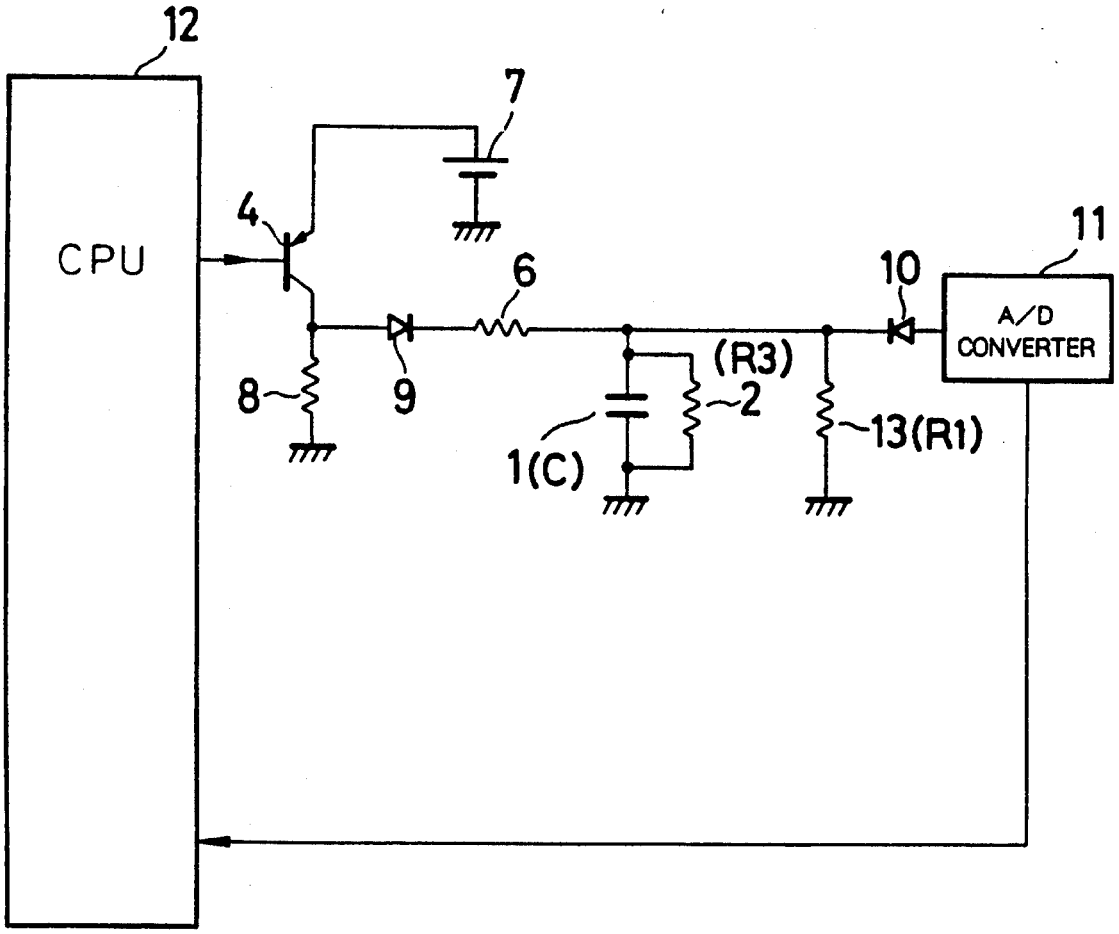
FIG.5 PRIOR ART
FIG. 5 is a circuit diagram of conventional embodiment.
Figure 6:
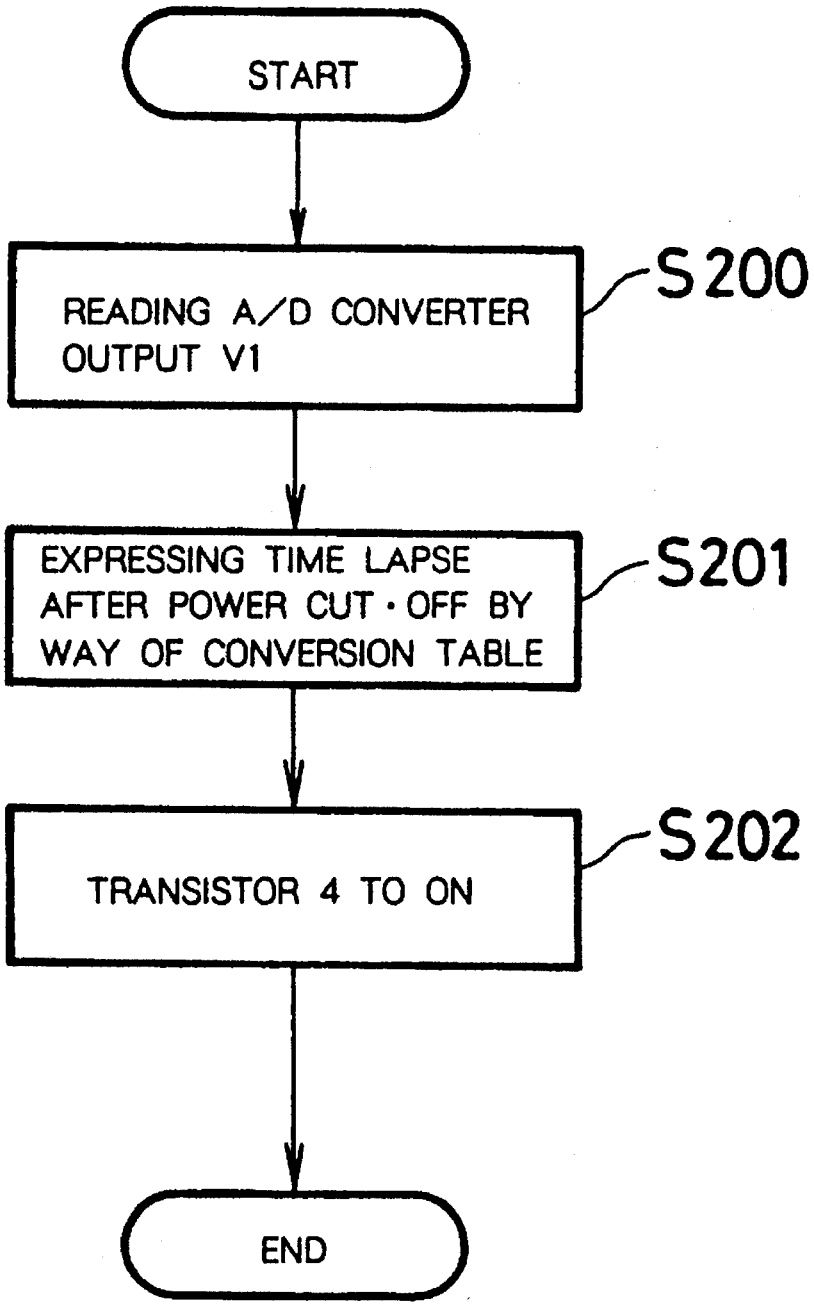
FIG.6 PRIOR ART
FIG. 6 is a flow chart of a conventional operation.

FIG. 4 illustrates the flow-chart on the CPU 12 control process in embodiment 2.

When the power source is turned on, CPU 12 reads the output value of A/D converter 11 (S100), and the read value is stored in the memory (not shown) (S101).

Then CPU 12 continues to keep transistor 4 ON-conditioned until the capacitor voltage reaches the approximate value of predetermined voltage EO (S102–S104).

If the capacitor voltage does not attain predetermined voltage value EO within predetermined time T (S103, YES), CPU 12 indicates the error to the outside equipment such as a computer and others not shown, and terminates the control. When the capacitor voltage attains predetermined voltage value EO within predetermined time T (S104, YES), CPU 12 switches transistor 4 OFF (S106) and switches transistor 5 ON (S107) at the same time and begins time measuring (S108). When the capacitor 1 voltage attains V1 which is as same value as stored in the memory (S109, YES), CPU 12 switches transistor 5 OFF to stop time lapse counting (S110). CPU 12 decides the counted value as the time lapse (in minutes) after power source being turned off.

Then, transistor 4 is switched ON (S112) to prepare for coming turned off of the power source.

The time lapse measured with the method mentioned above, is also applicable to setting of parameter values after power source being turned on for image producing device and others.

The present invention is not limited within the scope of above mentioned embodiments, but wider variations are possible within the scope mentioned in the claims.

What is claimed is:

1. A method for measuring time lapse comprising the steps of:

a) charging a capacitor up to a first predetermined voltage while a power source of an equipment is turned on;

b) discharging the electric charge in the capacitor through a first resistor having a first resistance when the power source of the equipment is turned off;

c) measuring and storing in a memory the voltage of the capacitor at the time when the power source of the equipment is turned on;

d) charging the capacitor to a second predetermined voltage, then discharging the electric charge in the capacitor through a second resistor having a second resistance;

e) measuring a time of discharge from the beginning of the discharging of the capacitor in step (d) until the voltage of the capacitor reduces to the same voltage value stored in the memory at step (c); and f) calculating a time lapse between turning off and turning on the power source of the equipment by using the time of discharge measured at step (e) and the respective first and second resistance of the first and second resistors.

2. A method according to claim 1, wherein the time lapse of step (f) is calculated by multiplying the time of discharge measured at step (e) by the ratio of the first resistance of the first resistor to the second resistance of the second resistor.

3. A method according to claim 1, wherein the first resistance of the first resistor is greater than the second resistance of the second resistor.

4. A method according to claim 1, wherein the time lapse of step (f) is calculated by applying to a table stored in the memory the time of discharge measured in step (e) and the ratio of the first resistance of the first resistor to the second resistance of the second resistor the.

5. A method for measuring time lapse comprising the steps of:

a) charging a capacitor up to a predetermined voltage while a power source of an equipment is turned on;

b) discharging the electric charge of the capacitor through a first discharging time constant, when the power source of the equipment is turned off;

c) conducting a simulation of the electric discharge of the capacitor in step (b) through a second discharging time constant, which is less than the first discharging time constant, while the power source of the equipment is on; and d) calculating a time lapse between turning off and turning on the power source of the equipment based on the time required for discharging the capacitor in the simulation of step (c) and the ratio of the first and second discharging time constants.

6. A method according to claim 5, wherein between steps (b) and (c), there is performed a step (e) of measuring and storing a voltage of the capacitor at the time when the power source of the equipment is turned on in step (c), and wherein in the step (d), the time lapse is calculated by using the time required for the capacitor voltage in the simulation to reduce to the same voltage stored in the step (e) and on the ratio of the first discharging time constant to the second discharging time constant.

7. A method according to claim 5, wherein the electric charge of the capacitor is discharged through a first resistor corresponding to the first discharging time constant in step (b) and the electric charge of the capacitor is discharged through a second resistor corresponding to the second discharging time constant in step (c).

8. A method for measuring time lapse after turning off a power source of an equipment, the equipment being provided with a first switching means, a direct current constant voltage power source connected to the first switching means, a capacitor to be charged by the first switching means, a first resistor having a first resistance connected in parallel with the capacitor, a second switching means, and a second resistor having a second resistance connected in parallel with the first resistor and connected in series with the second switching means, said method comprising the steps of:

a) charging the capacitor with the direct current constant voltage power source after switching on the first switching means;

b) discharging the electric charge of the capacitor through the first resistor in response to turning off the power source of the equipment;

c) charging the capacitor with the direct current constant voltage power source after detecting the capacitor voltage, in response to turning on the power source of the equipment, and then switching on the first switching means;

d) discharging the electric charge of the capacitor through the second resistor after charging the capacitor at step (c) by switching off the first switching means and switching on the second switching means;

e) measuring the time from the beginning of the capacitor discharge through the second resistor until the voltage of the capacitor is reduced to the same voltage detected in step (c); and f) calculating the time lapse between turning off and turning on the power source of the equipment by using the time measured at step (e) and the respective first and second resistances of the first and second resistors.

9. A method according to claim 8, wherein the first resistance of the first resistor is greater than the second resistance of the second resistor.

10. A method according to claim 8, wherein the time lapse is calculated by multiplying the time measured at step (e) by the ratio of the first resistance of the first resistor to the second resistance of the second resistor.

11. A device for measuring time lapse after turning off an electric power source of an equipment, comprising:

a capacitor;

charging means for charging said capacitor when the electric power source of the equipment is turned on;

discharging means for discharging the electric charge of said capacitor charged by said charging means, wherein said discharging means is equipped with a first resistor having a first resistance and a second resistor having a second resistance;

voltage detecting means for detecting a capacitor voltage;

control means for controlling the charging and discharging, wherein the electric charge of said capacitor is discharged through the first resistor of the discharging means in response to turning off of the electric power source of the equipment, then, in response to turning on of the electric power source said capacitor is charged, followed by discharging the electric charge of said capacitor through said second resistor of said discharging means;

measuring means for measuring the time lapse from the beginning of said capacitor discharge through said second resistor to the time the detected voltage from the detecting means is reduced to the same voltage as is stored in said storage means; and means for calculating the time lapse between turning off and turning on the electric power source of said equipment by using the time measured by said measuring means and the respective first and second resistances of said first and second resistors.

12. A device for measuring time lapse according to claim 11, wherein said calculating means calculates the time lapse by multiplying the time measured by said measuring means by the ratio of the first resistance of said first resistor to the second resistance of said second resistor.

13. A device for measuring time lapse according to claim 11, wherein the first resistance of said first resistor is greater than the second resistance of said second resistor.

14. A device for measuring time lapse after turning off an electric power source of an equipment, comprising:

a capacitor;

charging means for charging said capacitor when the electric power source of said equipment is turned on;

discharging means for discharging the electric charge of said charging means through said first discharging time constant in response to turning off of the electric power source of the equipment;

simulation means for simulating the electric discharge of said capacitor through the second discharging time constant, when the power source of the equipment is turned on;

measuring means for measuring the time required for discharging a capacitor by said simulation means; and means for calculating the time lapse between turning off and turning on the electric power source of the equipment by using the time measured by said measuring means and the ratio of said first and second discharging time constants.

15. A device for measuring time lapse according to claim 14, further comprising:

detecting means for detecting said capacitor voltage; and storage means for storing the voltage detected by said detecting means at the time the electric power source of the equipment is turned on, wherein said measuring means measures the time required for the capacitor voltage detected by said detecting means to be reduced to the same voltage as is stored in said storage means by discharging through said simulation means.

16. A device for measuring time lapse according to claim 14, wherein said discharging means discharges the electric charge of said capacitor by the first discharging time constant and said simulation means discharges the electric charge of said capacitor by the second discharging time constant.

17. A device for measuring time lapse after turning off an electric power source of an equipment, comprising:

first switching means to be switched off in response to turning off of the electric power source of the equipment;

a direct current constant voltage supplier connected to said first switching means;

a capacitor to be charged with said direct current constant voltage supplier;

a first resistor having a first resistance connected in parallel with said capacitor for discharging the electric charge in said capacitor;

second switching means;

a second resistor having a second resistance connected in parallel with said first resistor and connected in series with said second switching means;

detecting means for detecting said capacitor voltage;

storage means for storing the voltage detected by said detecting means;

clock means for measuring a time lapse;

control means for switching said first and second switching means, wherein said control means commands said storage means to store the voltage detected at the time the electric power source of the equipment is turned on, then commands said first switching means to switch off and said second switching means to switch on in order to discharge the electric charge in said capacitor, then commands said second switching means to switch off when the voltage detected by said detecting means is reduced to the same voltage stored in said storage means, and then commands said first switching means to switch on; and time lapse calculating means for calculating said time lapse by using the respective first and second resistances of said first and second resistors and the time lapse obtained by said clock means, said time lapse being from the time beginning of the discharge of said capacitor through said second resistor to the time that the voltage detected by said detecting means reduces to the same voltage stored in said storage means.

18. A device for measuring time lapse according to claim 17, wherein the first resistance of said first resistor is greater than the second resistance of said second resistance.

* * * * *